United States Patent [19]

Cecchi

[11] 4,209,138

[45] Jun. 24, 1980

[54] TAPE WINDING APPARATUS

[75] Inventor: Aristide Cecchi, Riverside, N.J.

[73] Assignee: RJM Manufacturing, Inc., Cornwells Heights, Pa.

[21] Appl. No.: 911,660

[22] Filed: Jun. 1, 1978

[51] Int. Cl.[2] ..... B65H 19/04

[52] U.S. Cl. ..... 242/56.9; 242/72 R

[58] Field of Search ..... 242/56.9, 72 R, 72 B, 242/72.1; 279/2 A

[56] References Cited

U.S. PATENT DOCUMENTS

| | | | |
|---|---|---|---|
| 3,025,071 | 3/1962 | Larrad | 242/72 R X |
| 3,853,280 | 12/1974 | Pennisi et al. | 242/72 B X |
| 3,878,999 | 4/1975 | Daves | 242/56.9 |
| 3,917,187 | 11/1975 | Damour | 242/72 B |
| 4,026,491 | 5/1977 | Boestroem | 242/56.9 X |

FOREIGN PATENT DOCUMENTS

| | | | |
|---|---|---|---|
| 1209841 | 1/1966 | Fed. Rep. of Germany | 242/72 R |

*Primary Examiner*—John M. Jillions

*Attorney, Agent, or Firm*—Seidel, Gonda, Goldhammer & Panitch

[57] ABSTRACT

The apparatus has a plurality of sets of core engaging segments supported by a shaft and guided for movement in a radial direction. Spring means biases the segments to a retracted position. Each segment has a piston communicating with a source of pressurized air for biasing the segments to an extended core-engaging position.

12 Claims, 5 Drawing Figures

FIG. 3
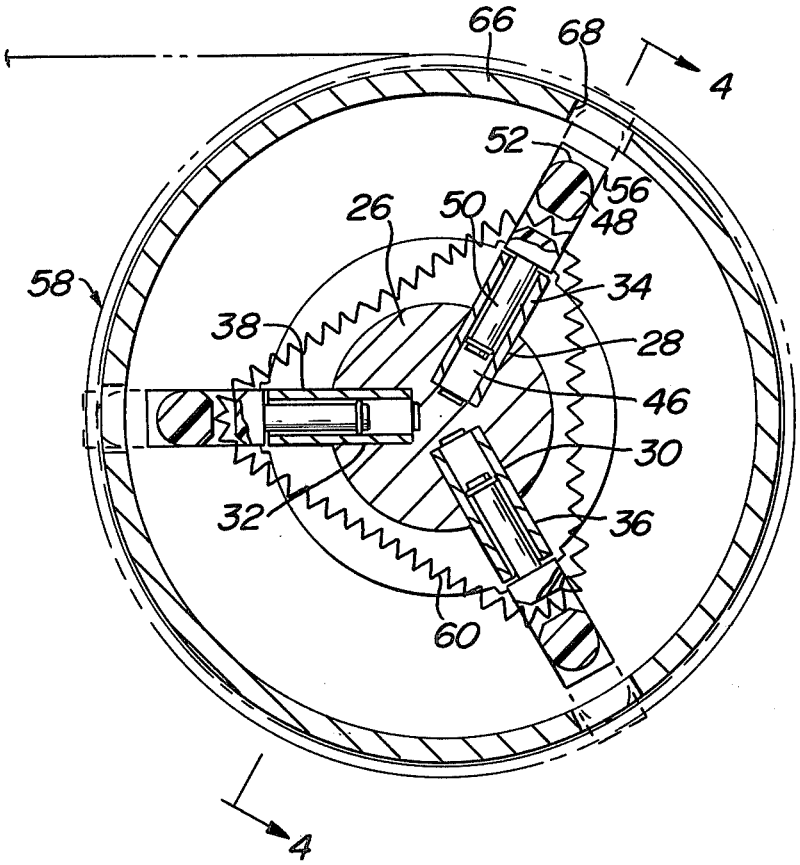
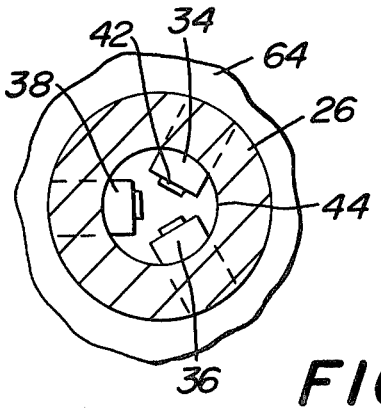
FIG. 5

TAPE WINDING APPARATUS

BACKGROUND

A wide variety of tape winding apparatus has been proposed heretofore. The most relevant types insofar as the present invention in concerned are prior art devices wherein core engaging segments are biased outwardly by an expandable bladder or tube. U.S. Pat. Nos. 3,853,280 and 4,026,491 are representative of such prior art devices used in utilizing a bladder or tube. If the bladder or tube is punctured, the entire device must be disassembled and a new tube or bladder substituted therefor. Another problem with such bladder or tube prior art devices is that they operate on low pressure air, that is, below 30 psi, and which is difficult to accurately control.

Another relevant type of prior art device is one wherein the core engaging segments are provided with a piston which when pressurized biases the segments radially outwardly into engagement with a core. U.S. Pat. No. 3,010,671 is representative of such a device. The last-mentioned patent utilizes a separate discrete clutch for each core engaging member whereby the individual clutch members constitute spacers which are objectionable. The spacers constitute a means for accumulating errors when it is desired to accurately position the sets of core engaging segments. Further, spacers constitute a limitation on the number of sets of core engaging members which may be utilized over a set predetermined length of the apparatus, and substantially increase the weight of the mandrel.

The above and other disadvantages of the prior art are overcome by the present invention.

SUMMARY OF THE INVENTION

The present invention is directed to tape winding apparatus which includes a set of core engaging segments, and preferably a plurality of such sets, supported by a shaft and guided for movement in a radial direction between an inoperative retracted position and an extended core engaging position. Each segment has an arcuate core engaging end face for frictional contact with the inner peripheral surface of the core. A first means biases the segments radially inwardly to a retracted position. Each segment has a piston integral therewith. The diameter of each piston is narrower than the axial length of the arcuate end face of the associated segment. A passage means is associated with the shaft for supplying pressurized air to each piston for simultaneously biasing the pistons radially outwardly so that the segments move from their inoperative retracted positon to their extended core engaging position.

It is an object of the present invention to provide a novel tape winding apparatus wherein a plurality of tapes may be simultaneously wound on individual cores closely adjacent one another in a manner which permits independent differential slip with identical friction on the cores and without the attendant problems of using an expandable bladder or hose, while minimizing weight of the mandrel.

Other objects will appear hereinafter.

For the purpose of illustrating the invention, there is shown in the drawings a form which is presently preferred; it being understood, however, that this invention is not limited to the precise arrangements and instrumentalities shown.

FIG. 3 is a sectional view taken along the line 3—3 in FIG. 2 but on an enlarged scale.

FIG. 5 is a sectional view taken along the line 5—5 in FIG. 4.

Figure 1:
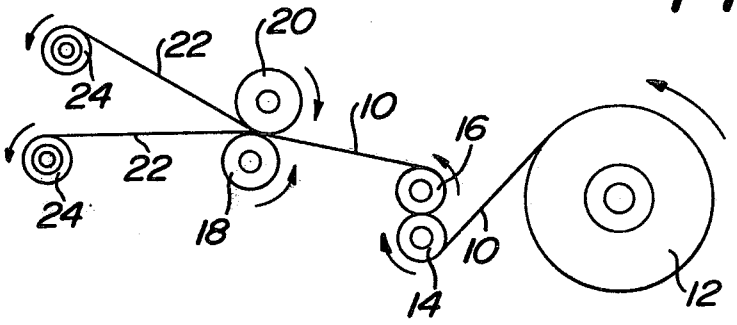
FIG. 1 is a schematic illustration showing how a large supply roll is slit into a plurality of narrower rolls.

Referring to the drawings in detail, wherein like numerals indicate like elements, there is shown in FIG. 1 a wide web 10 being unwound from a supply roll 12. The web 10 is unwound from the roll 12 by a pair of unwind rolls 14, 16 and then fed to an anvil roll 18. As the web 10 passes over the anvil roll 18, it is slit into narrower strips 22 by the knife roll 20. Strips 22 are then separately wound on rewind apparatus designated generally as 24. The rewind apparatus 24 constitutes the subject matter of the present invention.

The rewind apparatus 24 includes a central shaft 26. Referring initially to FIG. 3, it will be noted that shaft 26 is provided with longitudinally extending channels 28, 30 and 32 which are equidistant from one another. While three such channels are preferred, any plurality of such channels may be utilized. Within channel 28, there is provided a segment carrier 34. Within channel 30, there is provided a segment carrier 36. Within channel 32, there is provided a segment carrier 38. The segment carriers 34, 36 and 38 are identical. Hence, only segment carrier 34 will be described in detail.

The segment carrier 34 is an elongated metal bar which rests on a shoulder at the bottom of the channel 28 which is spaced radially outwardly from a manifold 42. See the central portion of FIG. 4. Each of the manifolds 42 communicates at one end thereof with a passageway 44 in the shaft 26 as will be apparent from the righthand end of FIG. 4. The manifold 42 is a part of the channel 28.

The segment carrier 34 is provided with a plurality of bores 46 at spaced points therealong. The bores are radially disposed as will be apparent from FIG. 3. One end of each bore 46 is in direct communication with the manifold 42. The segment carrier 34 supports on its outer peripheral surface a plurality of core segments 48. Each core segment 48 has a piston 50 extending into and guided by one of the bores 46. As will be apparent from FIG. 4, the core segments 48 are closely adjacent one another so that the maximum number of tapes may be simultaneously wound on an apparatus in accordance with the present invention having a predetermined length. In other words, there are no spacers between the adjacent core segments 48. The minimum distance between bores 46 is less than the axial length of segments 48. See FIG. 4.

Figure 2:
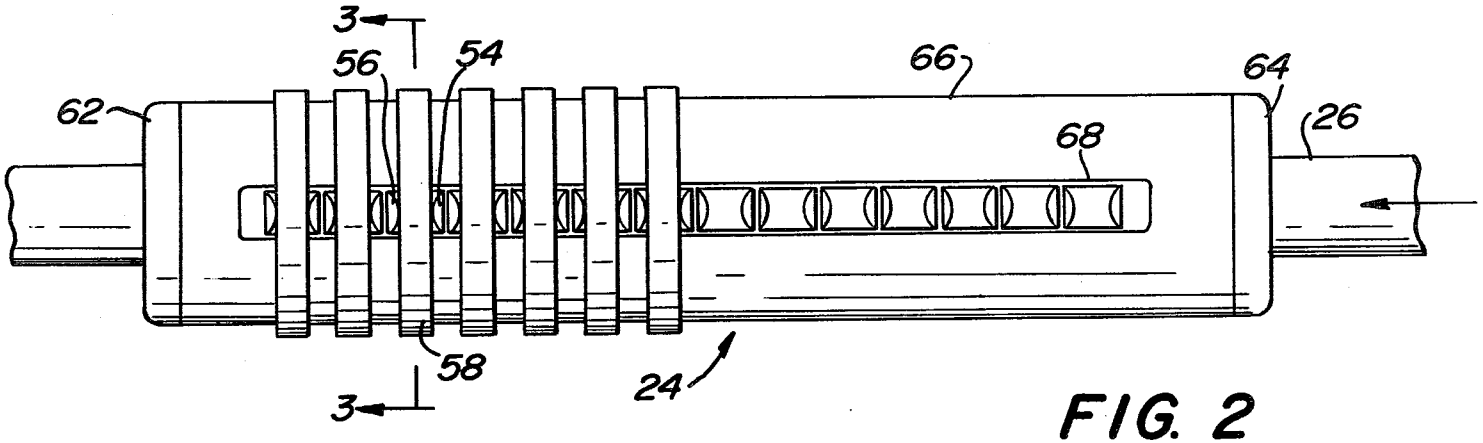
FIG. 2 is a plan view of apparatus in accordance with the present invention.

The core segments 48 have a recess on their outer peripheral surface designated 52 and which is arcuate as will be seen from FIG. 3. The ends of the recess 52 are defined by shoulders 54, 56. As will be apparent from FIG. 2, the juxtaposed faces of the shoulders 54, 56 are arcuate so that the segments 48 are self-aligning if there is any slight misalignment between the segments and their associated core 58. Moreover, the minimum distance between the arcuate juxtaposed faces on the shoulders of each core segment is at the crest of the arcuate end face 52 of the core segment. To assist in maintaining alignment of the core segments 48, and to maintain the core segments 48 in a retracted inoperative position when there is no pressurized air in manifold 42, a pair of springs 60 are provided for each core segment. As shown more clearly in FIGS. 3 and 4, the springs 60 are on opposite sides of the piston 50 and extend through a hole in each core segment of a set of core segments associated with a single core 58.

Figure 4:
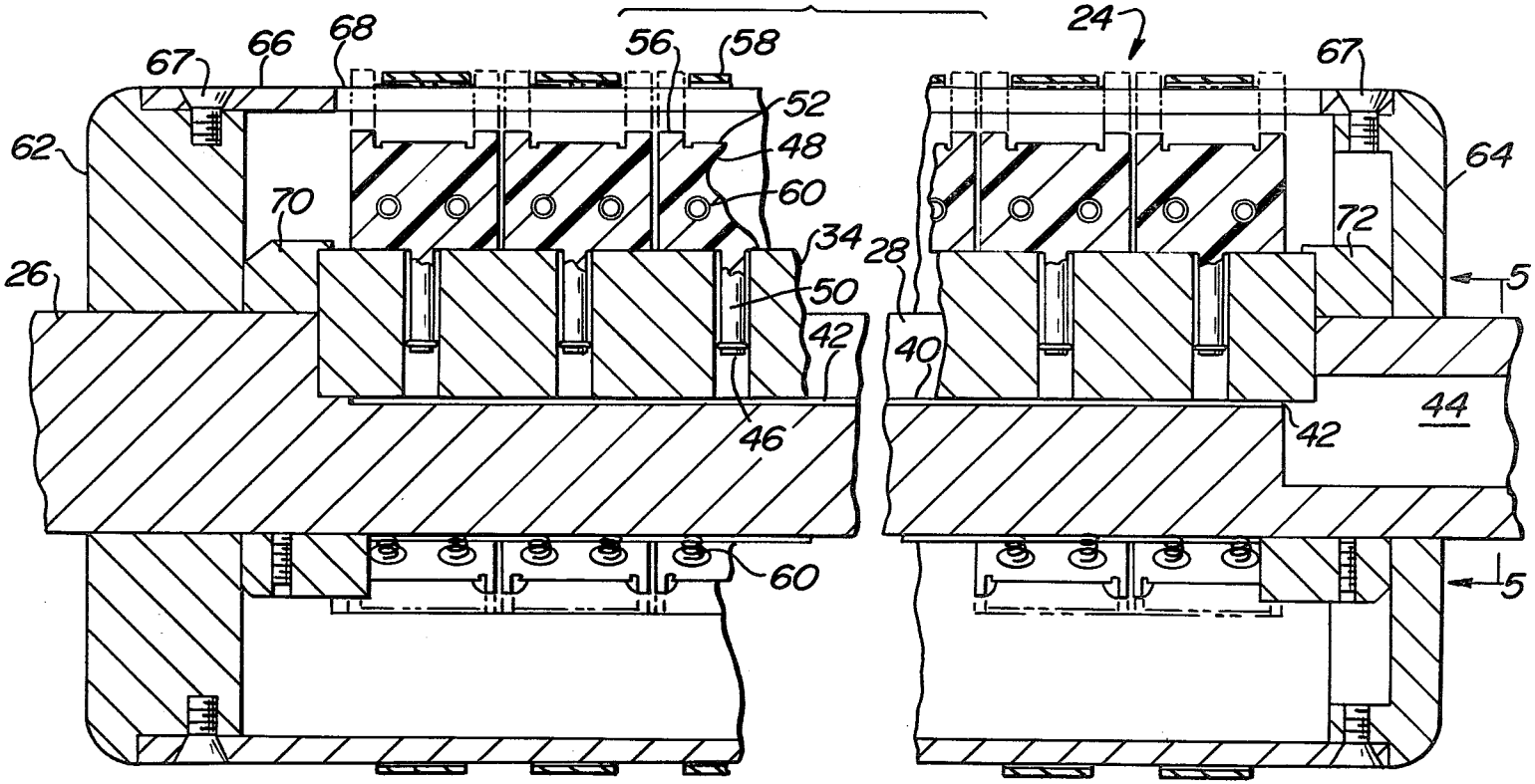
FIG. 4 is a sectional view taken along the line 4—4 in FIG. 3.

The apparatus 24 includes a header 62 at one end and a header 64 at the opposite end. The headers 62, 64 are interconnected by way of a cylindrical sleeve 66 and threaded fasteners 67 as shown in FIG. 4. The spacing between the headers 62, 64 is defined by the mounting blocks 70, 72 each fixedly secured to the shaft 26 in any convenient manner such as by a set screw as shown in FIG. 4. The distance between the juxtaposed faces of blocks 70, 72 corresponds to the length of the channel 28 and the segment carrier 34 disposed within said channel 28.

The tape winding apparatus 24 is utilized as follows. The cores 58 are assembled into a core box not shown so as to predispose the cores 58 in a predetermined position spaced from one another. The apparatus 24 is inserted through the core box and positioned against a limit stop so that the surface 52 on each of the core segments 48 is juxtaposed to but radially inwardly from the inner periphery of one of the cores 58. Thereafter, the apparatus is removed from the core box. Passage 44 and the manifolds 42 are pressurized with air at pressure such as 60 psi. The core segments 42 are thereby biased radially outwardly from the solid line to phantom positions shown in FIG. 4 and against the bias of the springs 60. A slit tape strip 22 is attached to each of the cores 58. Thereafter, the shaft 26 is rotated about its longitudinal axis to wind the strips 22 on the cores 58.

Depending upon the nature of the strips 22, a variety of different problems can be encountered such as a variation in the gauge of one strip 22 in comparison with another strip 22. The present invention will enable the cores 58 to independently slip with respect to their core segments 48. As will be apparent from FIG. 3, the radius of curvature of the recess 52 is substantially less than the radius of curvature of the core 58 whereby the core segments 48 have line contact with the inner peripheral surface of the associated core 58. When the pressure in passage 44 is vented to atmosphere, the springs 60 return the core segments 48 to the solid line position shown in FIG. 4. Thereafter, the wound cores 58 may be stripped off the sleeve 66.

The mounting blocks 70, 72 each have a lip as shown in FIG. 4 to prevent the segment carrier 34 from being biased radially outwardly along with the core segments 48. To prevent loss of air between the segment carrier 34, shaft 26, and the mounting blocks 70, 72, the exposed faces of such elements may be spray coated with epoxy or some other material to act as a seal against leakage.

The present invention may be embodied in other specific forms without departing from the spirit or essential attributes thereof and, accordingly, reference should be made to the appended claims, rather than to the foregoing specification, as indicating the scope of the invention.

I claim:

1. Tape winding apparatus including a shaft, at least one set of core engaging segments supported by said shaft and guided for movement in a radial direction between an inoperative retracted position and an extended core engaging position, said segments being uniformly spaced peripherally about said shaft, each segment having an arcuate outer peripheral end face for contact with a core, each arcuate end face of each segment being defined at the ends thereof by shoulders, the juxtaposed faces of said shoulders on each segment being arcuate so that the minimum distance between said shoulders on each segment is at the crest of the arcuate end face, first means biasing said segments to their retracted position, each segment having a piston which is narrower than the length of the segment in a direction parallel to the longitudinal axis of said shaft, passage means associated with said shaft for supplying pressurized air to said pistons for simultaneously biasing said pistons radially outwardly to overcome said first biasing means and move the segments from their retracted position to their extended core engaging position.

2. Apparatus in accordance with claim 1 wherein said first biasing means includes a pair of coil springs, said springs being on opposite sides of each piston, each coil spring biasing each core segment of the set to their respective inoperative retracted positions.

3. Apparatus in accordance with claim 1 including a plurality of sets of core engaging segments, said sets being disposed side-by-side without any spacer between adjacent sets.

4. Apparatus in accordance with claim 3 wherein said shaft has a plurality of equidistant channels on its outer periphery, a segment carrier in each channel, matching sets of bores in each carrier, each bore receiving one of said pistons, and said passage means including a discrete manifold radially inwardly of each carrier, said shaft having a passage communicating with each of said manifolds at one end thereof.

5. Apparatus in accordance with claim 4 wherein the minimum distance between adjacent bores is less than the length of the core segments in an axial direction of said shaft.

6. Tape winding apparatus including a shaft, a plurality of sets of core engaging segments supported by said shaft, each segment being guided by a discrete piston for movement in a radial direction between an inoperative retracted position and an extended core engaging position, said segments being uniformly spaced peripherally about said shaft, each segment having an arcuate outer peripheral end face for contact with a core, a shoulder at the end of each arcuate end face of each segment, the juxtaposed faces of said shoulders on each segment being arcuate so that the minimum distance between said shoulders on each segment is at the crest of the arcuate end face, spring means for each set for simultaneously biasing said segments of each set to their retracted position, each segment having a piston manifold means associated with said shaft for supplying pressurized air to said pistons for simultaneously biasing said pistons radially outwardly to overcome said first biasing means and move the segments from their retracted position to their extended core engaging position.

7. Apparatus in accordance with claim 6 wherein said spring means includes a pair of coil springs for each set, said springs being on opposite sides of each piston of the set, each coil spring biasing each core segment of its set to their respective inoperative retracted positions.

8. Apparatus in accordance with claim 7 including a plurality of sets of core engaging segments, said sets being disposed side-by-side without any spacer between adjacent sets.

9. Apparatus in accordance with claim 6 wherein said shaft has a plurality of equidistant channels on its outer periphery, a segment carrier in each channel, matching sets of bores in each channel, each bore receiving one of said pistons, and said manifold means being radially inwardly of each carrier, said shaft having a passage communicating with said manifold means at one end thereof, and the minimum distance between adjacent bores is less than the length of the core segments in an axial direction of said shaft.

10. Apparatus for winding tape on cores in a manner that permits independent differential slip comprising a shaft, a plurality of sets of core engaging segments supported by said shaft and guided for movement in a radial direction between an inoperative retracted position and an extended core engaging position, said sets of segments being disposed side by side without any spacer between adjacent sets, the segments of each set being spaced peripherally about said shaft, at least some of said segments having end faces for contact with a core, first means coupled to said some of said segments radially inwardly of their end faces for biasing said segments to their retracted position, said some of said segments having a piston which is narrower than the length of the segment in a direction parallel to the longitudinal axis of said shaft, said shaft having a plurality of longitudinally extending channels on its outer periphery, a segment carrier in each channel, said segment carrier being seated on said shaft at one end of said carrier and being spaced radially outwardly from said shaft along the length thereof from said seating to the opposite end of said carrier to provide a passage for supplying pressurized fluid to said pistons for simultaneously biasing said pistons radially outwardly to overcome said first biasing means and move at least some of said segments from their retracted position to their extended core engaging position.

11. Apparatus in accordance with claim 10 wherein said first biasing means includes a pair of coil springs for each set of segments, said springs on each set of segments being on opposite sides of their associated piston.

12. Apparatus for winding tape on cores in a manner that permits independent differential slip comprising a shaft, a plurality of sets of core engaging segments supported by said shaft and guided for movement in a radial direction between an inoperative retracted position and an extended core engaging position, said sets of segments being disposed side by side without any spacer between adjacent sets, the segments of each set being spaced peripherally about said shaft, at least some of said segments having end faces for contact with a core, shoulders associated with sides of said some of said end faces, said shoulders projecting radially outwardly, first means coupled to said some of said segments radially inwardly of their end faces for biasing said segments to their retracted position, said some of said segments having a piston which is narrower than the length of the segment in a direction parallel to the longitudinal axis of said shaft, passage means associated with said shaft for supplying pressurized air to said pistons for simultaneously biasing said pistons radially outwardly to overcome said first biasing means and move at least some of said segments from their retracted position to their extended core engaging position; said shaft having a plurality of equidistant channels on its outer periphery, a segment carrier in each channel, matching sets of bores in each carrier, each bore receiving one of said pistons, said passage means including a discrete manifold radially inwardly of each carrier, said shaft having a passage at one end thereof communicating with each of said manifolds.

* * * * *